United States Patent [19]

Kasai

[11] Patent Number: 4,802,262

[45] Date of Patent: Feb. 7, 1989

[54] BUCKLE ASSEMBLY

[75] Inventor: Kazumi Kasai, Namerikawa, Japan

[73] Assignee: Yoshida Kogyo K. K., Tokyo, Japan

[21] Appl. No.: 83,462

[22] Filed: Aug. 10, 1987

[30] Foreign Application Priority Data

Aug. 12, 1986 [JP] Japan ..... 61-123530[U]

[51] Int. Cl.[4] ..... A44B 11/25

[52] U.S. Cl. ..... 24/606; 24/615; 24/633

[58] Field of Search ..... 24/606, 607, 614, 615, 24/633, 618, 616

[56] References Cited

U.S. PATENT DOCUMENTS

| | | | |
|---|---|---|---|
| 793,874 | 7/1905 | Eklund | 24/606 |
| 1,121,770 | 12/1914 | Smith | 24/606 |
| 1,607,085 | 11/1926 | Kilstrom | 24/606 |
| 1,701,970 | 2/1929 | Chaunard . | |
| 2,858,593 | 11/1958 | Irizarry | 24/606 |
| 3,072,938 | 1/1963 | Phaneuf | 24/615 X |
| 3,514,816 | 6/1970 | Inoue | 24/606 X |
| 4,035,877 | 7/1977 | Brownson et al. . | |
| 4,110,873 | 9/1978 | Verchere | 24/615 |
| 4,425,689 | 1/1984 | Fildan | 24/633 X |
| 4,559,679 | 12/1985 | Downey | 24/615 |
| 4,577,377 | 3/1986 | Kasai | 24/633 X |
| 4,679,282 | 7/1987 | Feng | 24/614 |

FOREIGN PATENT DOCUMENTS

| | | | |
|---|---|---|---|
| 0204250 | 12/1986 | European Pat. Off. . | |
| 3305884 | 8/1984 | Fed. Rep. of Germany . | |
| 624119 | 7/1927 | France | 24/606 |
| 59-31908 | 2/1984 | Japan . | |
| 60-31809 | 3/1985 | Japan . | |
| 60-24171 | 7/1985 | Japan . | |

*Primary Examiner*—Peter A. Aschenbrenner
*Assistant Examiner*—James R. Brittain
*Attorney, Agent, or Firm*—Hill, Van Santen, Steadman & Simpson

[57] ABSTRACT

A buckle assembly includes a plug member and a socket member releasably coupled together to connect opposite ends of a strap or belt. The plug member includes a cantilevered resilient tongue having a locking lug lockingly engageable with a stopper bar of the socket member to couple the plug and socket member. The socket member includes a cantilevered resilient flap having a releasing lug engageable with the locking lug to disengage the latter from the stopper bar when the resilient flap is depressed. The stopper bar is engageable with the resilient flap to prevent undue resilient deformation of the latter.

14 Claims, 4 Drawing Sheets

BUCKLE ASSEMBLY

BACKGROUND OF THE INVENTION

1. Field of the Invention:

This invention relates to a buckle assembly for releasably connecting belts, straps or the like on garments, bags, shoes, bottles, etc.

2. Prior Art

There are known a variety of buckles which include a socket member and a plug member releasably engageable therewith, both members being fabricated from a resilient material such as synthetic resins. A typical example of such buckle is disclosed in Japaneses Utility Model Publication No. 60-24171 in which the buckle, as illustrated in FIGS. 12 and 13 of the accompanying drawings, comprises a socket or female member 100 having a pressing tab 110 overlying a chamber 120 and a hook 130, and a plug or male member 200 having a tongue 210 to be inserted into the chamber 120, the tongue 210 including a spring portion 220 for locking engagement with the hook 130. Pressing the tab 110 releases the spring portion 220 from the hook 130, in which instance, however, the spring portion 220 is held down or jammed against the inner bottom wall of the socket 100 and becomes snagged, rendering it difficult to separate the plug member 200 from the socket member 100.

SUMMARY OF THE INVENTION

With the foregoing difficulties of the prior art in view, it is therefore the primary object of the present invention to provide a buckle assembly which is relatively simple in construction and highly reliable in use and which is in particular easy and smooth in coupling and uncoupling.

According to the present invention, there is provided a buckle assembly includes a plug member and a socket member releasably coupled together to connect opposite ends of a strap or belt. The plug member includes a cantilevered resilient tongue having a locking lug lockingly engageable with a stopper bar in the socket member to couple the plug and socket member. The socket member includes a cantilevered resilient flap having a releasing lug engageable with the locking lug to disengage the latter from the stopper bar when the resilient flap is depressed. The stopper bar is engageable with the resilient flap to prevent undue resilient deformation of the latter.

The foregoing and other objects and features will become apparent from the following detailed description taken in conjunction with the accompanying drawings. In the drawings, like reference numerals refer to like or corresponding parts throughout the several views.

DETAILED DESCRIPTION

Figure 1:
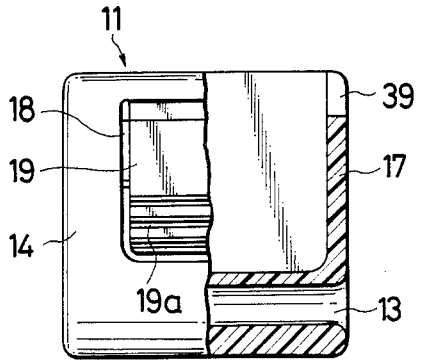
FIG. 1 is a top view, partly in cross section, of a socket member of the buckle assembly constructed in accordance with the invention.
Figure 2:
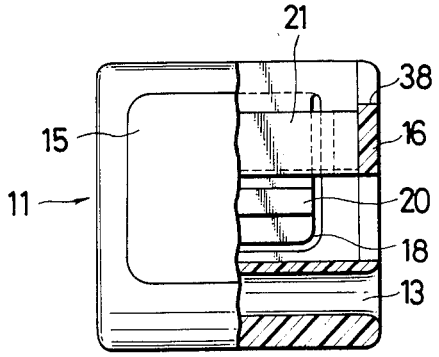
FIG. 2 is a bottom view, partly in cross section, of the socket member.

Referring now to the drawings and firstly FIGS. 1-4 inclusive, there is shown a socket member 11 which constitutes one part of a buckle assembly 10 (FIG. 8) embodying the invention. The socket member 11 is formed by molding polyacetal, nylon, polypropylene or other suitable plastic material into a generally rectangular casing having a guide chamber 12 for receiving a plug member (FIGS. 5, 6 and 7) which constitutes the other part of the buckle assembly 10. The socket member 11 has a transverse slot 13 in its rear end for receiving an end of a strap or belt not shown.

The case-like socket member 11 includes an upper wing 14 and a lower wing 15 which are interconnected by a pair of opposed side walls 16, 17. The upper wing 14 has a U-shaped cut-away groove 18 to provide a cantilevered resilient flap 19 capable of flexing about its fixed proximal end located adjacent to the front or open end of the socket member 11. The resilient flap 19 has on its outer surface a plurality of parallel spaced transverse ridges **19*a* with which the strip 19 is pressed inwardly toward the lower wing 15 to release the plug member in a manner hereafter described. The resilient flap 19 further includes a transverse releasing lug 20 formed integrally with and disposed on the inner surface of the resilient flap 19 adjacent to the distal end of the resilient flap 19** for pressure engagement with a corresponding locking lug later described, on the plug member.

Figure 3:
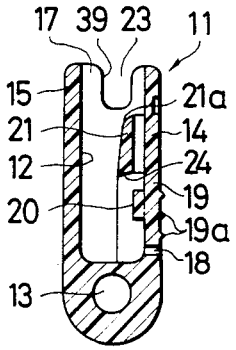
FIG. 3 is a longitudinal cross-sectional view of the socket part.
Figure 4:
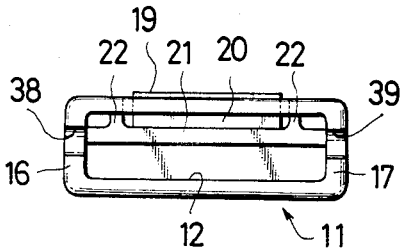
FIG. 4 is a front elevational view of the socket member.

The socket member 11 also includes a stopper bar 21 disposed between the upper and lower wings 14, 15 and extending transversely between the opposed side walls 16, 17 transversely across the guide channel 12, the stopper bar 21 being located closer to the upper wing 14 than to the lower wing 15. The stopper bar 21 is disposed closer to the open end of the socket member 11 than to the releasing lug 20 on the resilient flap 19 for locking engagement with the locking lug of the plug member. The stopper bar 21 is also engageable with the releasing lug 20 on the resilient flap 19 to limit inward deformation of the resilient flap 19 when the latter is pressed into the channel 12. With the stopper bar 21 thus constructed, the plug member can easily by removed from the socket member 11 as described later on. The stopper bar 21 is reinforced or made rigid by means of a pair of reinforcing studs 22 interconnecting the stopper bar 21 and the upper wing 14 on opposite sides of resilient flap 19 as better shown in FIG. 4. The stopper bar 21 has a canted rear surface 24 facing upwardly toward the releasing lug 20, as shown in FIG. 3, for locking engagement with a mating canted surface on the locking lug of the plug member. The stopper bar 21 has a thickness reducing progressively in a direction from the rear surface 24 toward the open end or inlet 23 of the socket member 11. The front surface of the stopper bar 21 is rounded as at 21*a* for enabling smooth reception of the plug member into the socket member 11.

Figure 5:
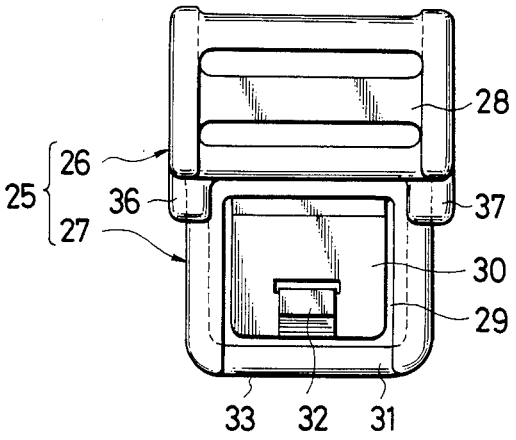
FIG. 5 is a plan view, partly in cross section, of a plug member of the buckle assembly.
Figure 6:
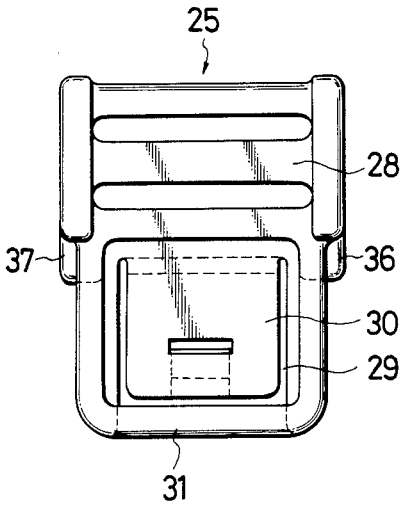
FIG. 6 is a bottom view, partly in cross section, of the plug member.
Figure 7:
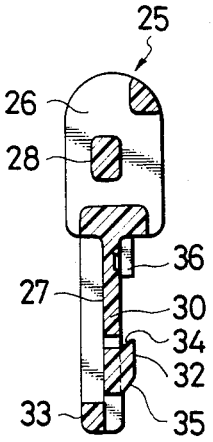
FIG. 7 is a longitudinal cross-sectional view of the plug member.

Referring now to FIGS. 5, 6 and 7 inclusive, there is shown a plug member 25 which constitutes the other half of the buckle assembly 10 and is adapted to be taken into and out of coupling engagement with the socket member 11. The plug member 25 is molded of the same plastic material as the socket member 11 and includes a thick stem portion 26 and a thin plate portion 27 extending from one end of the stem portion 26. The stem portion 26 has a hollow rectangular shape and includes a transverse crossbar 28 for connecting thereto the other end of the strap. The plate portion 27 is generally rectangular shape and has a U-shaped cut-away groove 29 to provide a cantilevered resilient tongue 30 which is peripherally surrounded and protected by a rigid U-shaped reinforcing rim 31 integrally connected at its opposite ends with the stem portion 26.

The resilient tongue 30 includes on its upper surface a locking lug 32 disposed adjacent to the distal end of the resilient tongue 30, the locking lug 32 being located close to the front end 33 of the U-shaped rim 31. The locking lug 32 has a canted rear surface 34 facing downwardly toward the upper surface of the resilient tongue 30 and lockingly engageable with the canted rear surface 24 (FIG. 3) of the socket member 11. The front surface 35 of the locking lug is also bevelled and extend substantially parallel to the canted rear surface 34. The bevelled front surface 35 is frictionally engageable with the releasing lug 20 (FIG. 3) when the resilient flap 19 is depressed, so that a downward pressure on the flap 19 is translated into a horizontal rearward thrust on the plate portion 27. This camming action enables a quick release of the plug member 25 from the socket member 11.

The plug member 25 also includes a pair of lateral protuberances 36, 37 disposed adjacent to the proximal or fixed ends of the U-shaped rim 31. The protuberances 36, 37 are engagedable with a pair of guide recesses 38, 39 (FIGS. 2 and 3) respectively formed in the opposite side walls 16, 17 of the socket member 11, so as to retain the socket plug members 11, 25 in coupled condition against vertical displacement.

Figure 8:
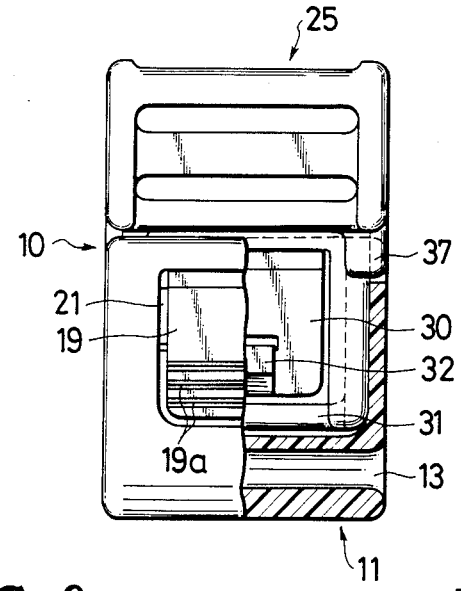
FIG. 8 is a plan view, partly in cross section, of the socket and the plug members coupled together.
Figure 9:
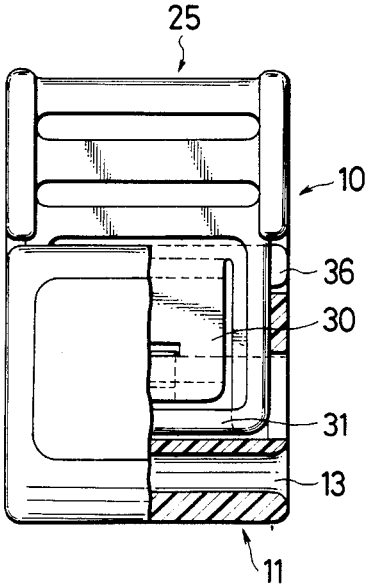
FIG. 9 is a bottom view, partly in cross section, of FIG. 8.
Figure 10:
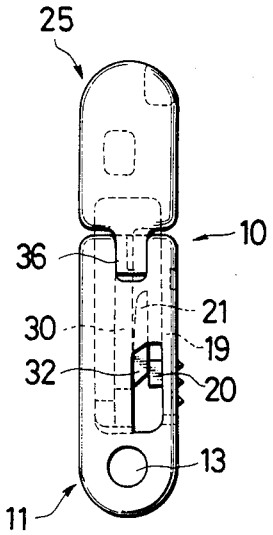
FIG. 10 is a longitudinal cross-sectional view of FIG. 8.

The operation of the buckle assembly 10 thus constructed with the socket member 11 and the plug member 25 will now be described. Inserting the plate portion 27 of the plug member 25 into the chamber 12 in the socket member 11 causes the resilient tongue 30 flex downwardly as the locking lug 32 slides frictionally along the contoured inner surface of the stopper bar 21. As the plate portion 25 is fully inserted into coupling engagement with the plate portion 27 as shown in FIGS. 8, 9 and 10, the resilient tongue 30 flips resiliently back to its original flat position and is so retained by interlocking engagement between the canted rear surface 34 of the locking lug 32 and the rear canted surface 24 of the stopper bar 21 so that the plug member 25 is locked in place against accidental release from the socket member 11.

Figure 12:
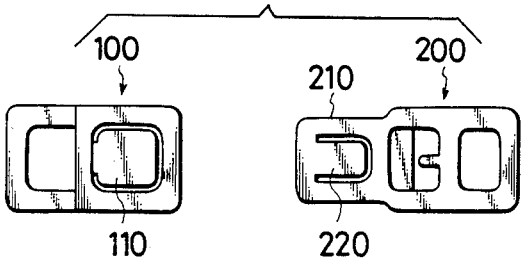
FIG. 12 PRIOR ART
FIG. 12 is a plan view of a known socket and plug assembly shown uncoupled.
Figure 13:
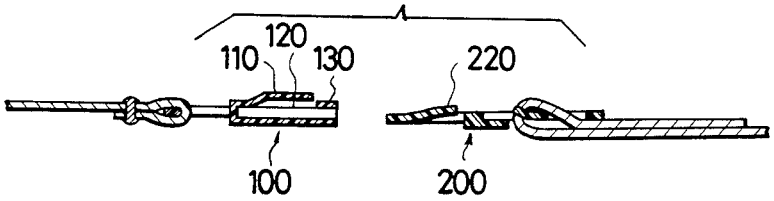
FIG. 13 PRIOR ART
FIG. 13 is a cross-sectional view of the known socket assembly connected to respective ends of a belt.

When releasing or uncoupling the plug member 25 from the socket member 11, this is done by pressing the resilient flap 19 inwardly until the releasing lug 20 forces the mating locking lug 32 to depart from the stopper bar 21, in which instance the lug 20 slides down the front bevelled surface 35 of the lug 32, affording a moment to urge the plug member 25 to spring out, thus releasing the same with utmost ease. The extent to which the resilient flap 19 of the socket member 11 is flexed inwardly is limitted by the stopper bar 21 so that the resilient tongue 30 of the plug member 25 is prevented from being jammed against the inner surface of the lower wing 15 of the socket member 11 which would otherwise occur to snag the plug member 25 as in the case of the prior art shown in FIGS. 12 and 13.

Figure 11:
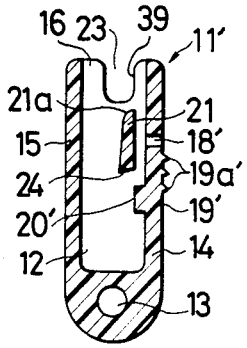
FIG. 11 is a longitudinal cross-sectional view of a modified form of socket member according to the invention.

A modified socket member 11' shown in FIG. 11 is substantially identical with the socket member 11 of the foregoing embodiment with the exception that a resilient flap 19' is resiliently deformable about its fixed proximal end disposed adjacent to the rear end of the socket member 11'. The resilient flap 19' is formed as a result of provision of a U-shaped cut-away groove 18' and has a plurality of transverse ridges 19*a'* and a releasing lug 20' that are structurally and functionally the same as those of the socket member 11.

Although various minor modifications may be suggested by those versed in the art, it should be understood that I wish to embody within the scope of the patent warrented hereon, all such embodiments as reasonably and properly come within the scope of my contribution to the art.

What is claimed is:

1. A buckle assembly comprising:

(a) a plug member molded of synthetic resin and including a resilient tongue having a locking lug disposed thereon; and (b) one-piece socket member molded of synthetic resin and adapted to be releasably coupled with said plug member, said one-piece molded socket member including (i) a pair of spaced upper and lower wings joined together by a pair of opposed side walls so as to define therebetween a guide channel for receiving therein said resilient tongue, said upper wing having a cut-away groove communicating with said guide channel to form a cantilevered resilient flap, said resilient flap having a releasing lug projecting into said guide channel, and (ii) a stopper bar extending between said side walls transversely across said guide channel and being spaced a distance from said releasing lug in a direction toward an inlet of said guide channel, said stopper bar being lockingly engageable with said locking lug to couple said plug and socket members, said releasing lug being engageable with said locking lug to urge the latter out of locking engagement with said stopper bar when said resilient flap is flexed toward said lower wing, and said stopper bar being engageable with said resilient flap to limit inwardly flexing movement of said resilient flap to such an extent that said resilient tongue of said plug member is prevented from being jammed against an inner surface of said lower wing of said socket member.

2. A buckle according to claim 1, said cut-away groove having a U-shape.

3. A buckle according to claim 1, said cantilevered resilient flap having a fixed end disposed adjacent to said inlet of said guide channel.

4. A buckle according to claim 1, said cantilevered resilient flap having a fixed end disposed adjacent to an end of said guide channel opposite to said inlet.

5. A buckle according to claim 1, said resilient flap having on its outer surface a plurality of ridges extending transverse to said guide channel.

6. A buckle according to claim 1, said stopper bar being disposed closer to said upper wing than to said lower wing.

7. A buckle according to claim 1, said stopper bar having a thickness progressively reducing toward said inlet of said guide channel.

8. A buckle according to claim 1, said stopper bar having a round front surface facing toward said inlet, and a canted rear surface facing upwardly toward said releasing lug.

9. A buckle according to claim 1, said stopper bar being joined at opposite ends with said side wall.

10. A buckle according to claim 1, said socket member further including a pair of guide recesses defined respectively in said side walls and opening in the same direction as said inlet, said plug member including a pair of lateral protuberances disposed on opposite sides of said resilient tongue adjacent to a fixed end of said tongue, said protuberances being guidedly receivable in said guide recesses, respectively.

11. A buckle according to claim 1, said locking lug including a bevelled front surface and a canted rear surface.

12. A buckle according to claim 1, said plug member further including a rigid reinforcing rim extending along the periphery of said resilient tongue with a groove defined therebetween.

13. A buckle according to claim 12, said groove having a U-shape.

14. A buckle assembly comprising:

(a) a plug member including a resilient tongue having a locking lug disposed thereon; and (b) a plug member adapted to be releasably coupled with said plug member and including (i) a pair of spaced upper and lower wings joined together by a pair of opposed side walls so as to define therebetween a guide channel for receiving therein said resilient tongue, said upper wing having a cut-away groove communicating with said guide channel to form a cantilevered resilient flap, said resilient flap having a releasing lug projecting into said guide channel, (ii) a stopper bar extending between said side walls transversely across said guide channel and being spaced a distance from said releasing lug in a direction toward an inlet of said guide channel, said stopper bar being lockingly engageable with said locking lug to couple said plug and socket members, and said releasing lug being engageable with said locking lug to urge the latter out of locking engagement with said stopper bar when said resilient flap is flexed toward said lower wing, and (iii) a pair of reinforcing studs interconnecting said stopper bar and said upper wing on opposite sides of said resilient flap.

* * * * *